US011299984B2

(12) United States Patent
Cantu et al.

(10) Patent No.: US 11,299,984 B2
(45) Date of Patent: Apr. 12, 2022

(54) SYSTEM AND METHOD FOR ENABLING TWO-WAY COMMUNICATION CAPABILITIES TO SLICKLINE AND BRAIDED LINE

(71) Applicants: Rogelio Cantu, Houston, TX (US); Mercy Renteria, Houston, TX (US)

(72) Inventors: Rogelio Cantu, Houston, TX (US); Mercy Renteria, Houston, TX (US)

( * ) Notice: Subject to any disclaimer, the term of this patent is extended or adjusted under 35 U.S.C. 154(b) by 0 days.

(21) Appl. No.: 16/727,831

(22) Filed: Dec. 26, 2019

(65) Prior Publication Data

US 2022/0082013 A1 Mar. 17, 2022

(51) Int. Cl.
*E21B 47/00* (2012.01)
*E21B 47/14* (2006.01)

(52) U.S. Cl.
CPC ..... *E21B 47/14* (2013.01)

(58) Field of Classification Search
CPC ..... E21B 47/14; E21B 47/12; E21B 47/092; E21B 47/16
See application file for complete search history.

(56) References Cited

U.S. PATENT DOCUMENTS 6,028,534 A * 2/2000 Ciglenec ..... E21B 23/00 340/856.2
2006/0250243 A1* 11/2006 Masino ..... E21B 47/12 340/572.1
2008/0106972 A1* 5/2008 Liang ..... E21B 47/26 367/25
2008/0253228 A1* 10/2008 Camwell ..... H04W 40/10 367/82
2014/0269188 A1* 9/2014 van Zelm ..... E21B 47/12 367/81
2015/0330190 A1* 11/2015 Wu ..... E21B 47/12 703/6
2016/0237811 A1* 8/2016 Reed ..... E21B 47/12
2020/0032643 A1* 1/2020 Gao ..... E21B 47/005

* cited by examiner

*Primary Examiner* — Munear T Akki

(57) ABSTRACT

Disclosed are methods and systems comprised of devices for enabling two-way communication between downhole tools and surface equipment through standard slickline and braided line cable and using such data to perform a variety of actions. The disclosed methods include surface and downhole communication modules, both of which contain a means to generate pulses, a means to detect pulses traveling through the cable, and onboard electronics; a surface control system acts as the principal input/output device and interface to a user, as data is displayed on such systems and its input device allows for this operator to send instructions to a plurality of downhole tools. Sensors, detectors, power sources, and actuators are all controlled by onboard electronics; and one or more processors operably connected to these devices. A processor is typically configured to receive data from the modules, record the data, and transmit data to allow for an operator to perform actions based on the data.

29 Claims, 7 Drawing Sheets

SYSTEM AND METHOD FOR ENABLING TWO-WAY COMMUNICATION CAPABILITIES TO SLICKLINE AND BRAIDED LINE

CROSS-REFERENCE TO RELATED APPLICATIONS

This application claims the benefit of the filing date of and priority to U.S. Provisional Application No. 62/784,733 entitled "METHOD FOR ADDING TWO-WAY COMMUNICATION CAPABILITIES TO SLICKLINE AND BRAIDED LINE SERVICES FOR OIL AND GAS WELLS" and filed on Dec. 25, 2018, Confirmation No. 7568. These applications are incorporated herein by reference for all purposes.

STATEMENT REGARDING FEDERALLY SPONSORED RESEARCH OR DEVELOPMENT

Not Applicable.

FIELD OF THE INVENTION

The present disclosure relates generally to oil and gas wireline services, in particular, those on which an insulated electric cable is not used, namely slickline and braided line services, as opposed to electric line services. The present disclosure also relates generally to methods, system and tools used to service oil and gas wells using slickline and braided line services.

BACKGROUND OF THE INVENTION

Slickline and braided line Services refer to a branch of oilfield wireline services which use a solid wire, referred to as slickline, or a braided wire, referred to as braided line, to convey a downhole tool string into a wellbore to perform a plurality of services. These solid or braided lines normally provide physical support as a means of hanging a tool-string which can be lowered into a wellbore, and do not convey electrical power or communication capabilities to send and/or receive data through it. The main difference between slickline and braided line, is the increased strength of the braided line cable, which allows for deploying heavier tool-strings and to apply a higher tensile load. This comes however, with a few drawbacks which include a heavier cable, and increased difficulty in sealing around the cable at the surface amongst others.

Extensive prior art exists in the use of slickline (and braided line) tools and slickline (and braided line) equipment. Most of these tools, however, are run and actuated by spooling or unspooling the cable, therefore pulling or releasing force on the cable translating into upward and downward motion on the tool-string. Typically, information available to an operator of slickline (and braided line) service equipment is limited to line tension (provided by a load cell), and an approximate tool-string depth (calculated by measuring the amount of wire that has been unspooled from the drum). In rare occasions, other methods have been implemented to actuate downhole tools in the tool-string; such methods include the use of timers, burst disks that rupture at specified pressures, or use changes in slickline tension to actuate perforating guns to name a few. These methods however, are limited to a very few specific and simple tasks, as the ability to receive data feedback from the tools in the wellbore, or to send complex instructions is not present.

Similarly, extensive prior art exists in connection with another branch of wireline services namely 'electric line' services, which differ from Slickline Services in that an insulated multi-conductor cable is used to lower the tool-string into a wellbore instead of the bare single or stranded cable used in slickline and braided line services. This insulated multi-conductor cable allows for delivering power and communication capabilities to the downhole tool-string ("Electric Line Services"). This allows for the use of more complex downhole tools which can perform a large variety of services such as well logging, perforating, well intervention, etc. Although many advantages are gained from using electric line services rather than slickline services, significant drawbacks can be recognized as well. Some of these include: a much higher cost, larger field-service crews, more difficult pressure control due to larger wire diameter, increased risk for wire damage, use of larger equipment with a sizeable footprint at the rig-site (which is typically very limited in space) and higher weight which makes transportation to remote or difficult areas more challenging, amongst others.

Enabling communication capabilities to slickline or braided line services can lead to expand the variety of tools and services that can be provided to oil and gas companies, increasing safety, reducing rig time and maintaining a lower cost when compared to traditional electric line services.

BRIEF SUMMARY OF THE INVENTION

The present invention describes a method and multiple embodiments of a system developed for enabling two-way communication between a downhole tool-string and surface equipment (equipment which is above ground) through slickline or braided line (for slickline and braided line services).

A method for enabling two-way communication between a downhole tool-string and surface equipment through a slickline or a braided line, consists on attaching the bottom end of the slickline or braided line cable to a comprising: a means to securing the cable or Cable Head, a Downhole Pulse-Detector Unit (DPDU) to detect pulses originated from a Surface Communication Module (SCM), a Downhole Pulse Generator Unit (DPGU), a Downhole Telemetry Unit (DTU), and a Downhole Power Unit (DPU) which supplies energy in the form of electricity to the DCM. The lower end of the DCM is further mechanically and electrically connected to a plurality of downhole tools that comprise a tool-string, whose components vary depending on the services that need to be performed in a wellbore.

The DCM is capable of collecting information and/or data from the plurality of downhole tools which are connected to it; this information is captured and decoded by the DTU and is then converted to a series of pulses (which will be from now on be referred to as downhole pulses' to avoid confusion with pulses generated from the surface equipment namely 'surface pulses') which are created by the DPGU and are sent to the surface as these travel through the slickline or braided line cable. This information and/or data in the form of downhole pulses can be generated and transmitted automatically at predetermined intervals or can be sent upon a request from the SCM.

At the surface, a Surface Communication Module (SCM) comprising of at least: a Surface Pulse-Detector Unit (SPDU), a Surface Pulse Generator Unit (SPGU), a Surface Data-Relay Unit (SDRU), and a Surface Power Unit (SPU) (amongst other possible components depending on the particular embodiment of this device), is capable of detecting downhole pulses via the SPDU, which is located in direct or indirect contact with a slickline or braided line cable. Direct contact in this context is defined as having a component of the SPDU touching the slickline or wireline cable, while, indirect contact is defined as having a component of the SPDU touching a component which is in contact with another component or several components of which one is ultimately is in direct contact with a slickline or braided line cable. The SDRU is used for transmitting said downhole pulses to a Surface Control System (SCS) which then decodes them into useful downhole data, and for receiving surface commands and data from a Surface Control System.

A Surface Control System is comprised of at least: a screen or display, at least one input device such as a mouse, a keyboard or a touchscreen, a communication module and a computer system inclusive of a CPU, memory, etc. Examples of a Surface Control System include but are not limited to a laptop computer, a tablet, a smartphone, or a custom-built surface control panel with integrated computing capabilities. The SCS is capable of receiving downhole pulses, decoding these pulses into useful data, displaying the data on a screen, and saving the data into memory.

A Surface Control System can be used by a person for issuing commands and/or for loading data to the plurality of downhole tools comprising a tool-string. These commands can include but are not limited to issuing instructions to specific downhole tools, requesting downhole data, or loading sensor calibration data, amongst others, and are encoded into instructions to generate a series of surface pulses; these instructions are then transmitted by the Surface Control System and received by the Surface Communication Module, which uses a Surface Pulse-Generator Unit to create surface pulses which then travel down a slickline or braided line cable.

The Downhole Communication Module (fitted with a Downhole Pulse-Detector Unit) detects surface pulses (pulses originated by the SPGU) and uses a Downhole Telemetry Unit to decode these pulses into useful data. This data is then relayed through a mechanical and electrical connection to the plurality of downhole tools which comprise a tool-string which causes for these tools to perform the instructions that the person operating the Surface Control Interface requires.

This method, together with certain required equipment (the different components described herein on their variety of embodiments) allow for Two-way interactions between a tool-string and a Downhole Communication Module, between a Downhole Communication Module and a Surface Communication Module, and between a Surface Communication Module and a Surface Control System comprise the basis of the method described herein and permit a broad range of data to be transmitted between downhole tools and a person or operator at the surface. This can facilitate operations such as real-time or near real-time downhole data collection like precise depth measurements, pressure, temperature, tubing internal diameter, flow rate, presence of particular chemical elements, precise tool positioning etc. and allow for a broader range of services/actions such as; actuation of motors, expansion or contraction of tool elements, opening or closing of valves or sleeves, axial movement such as in downhole tractor or stroking tool, actuation of an explosive change such as in a perforating gun, instruction to begin or terminate operations such as cutting, sampling or taking data, amongst many others possible commands.

REFERENCE NUMERALS IN THE DRAWINGS

Figure 1:
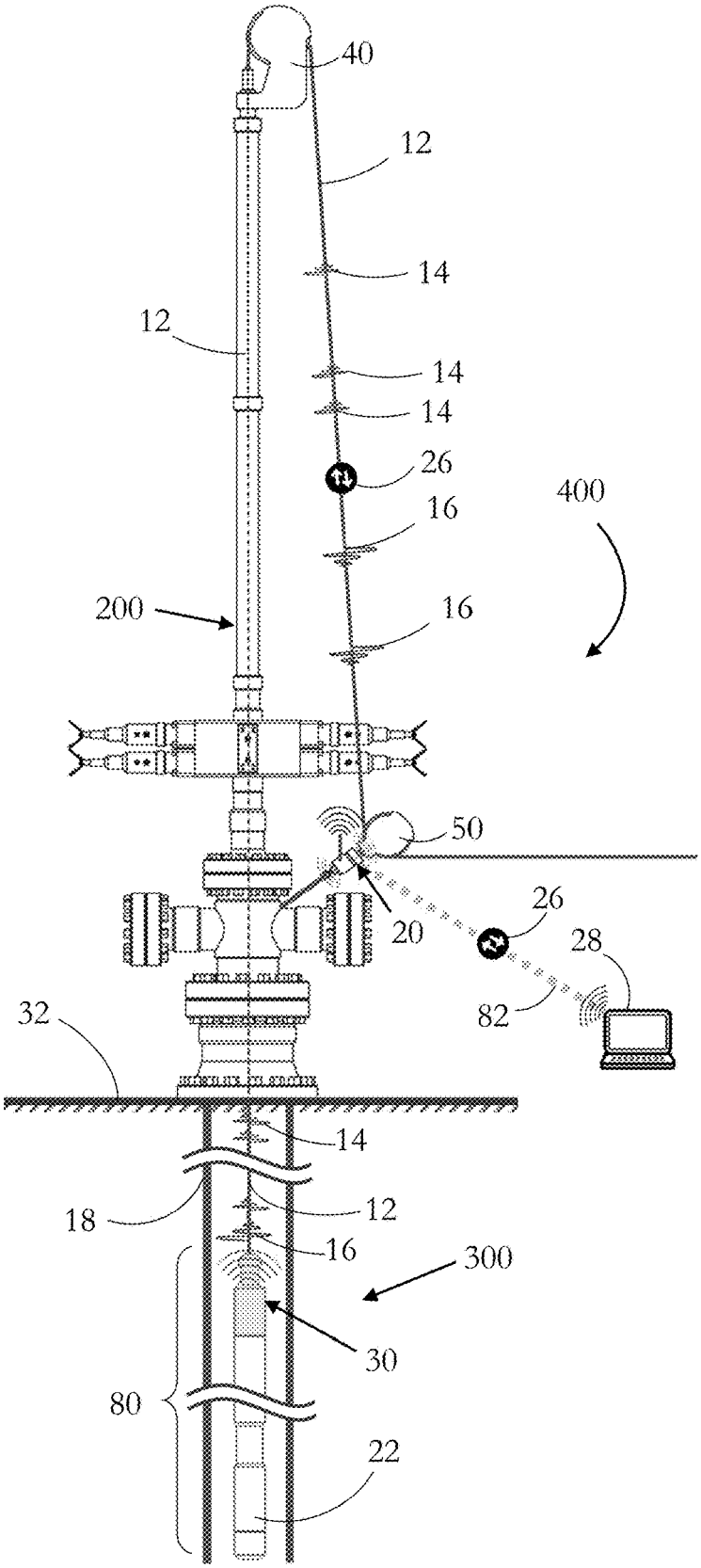
FIG. 1 Depicts an overview of the system for enabling communication capabilities to slickline or braided line cable along with typical equipment on which the modules described herein will be incorporated according to the method defined herein. The figure includes a depiction of a standard slickline or braided line installation consisting of a wellhead 42 with pressure control equipment comprising a blowout preventer 36, lubricator 34, and stuffing box 60. The assembly is fitted with an upper sheave 40, a lower sheave 50 and a Surface Communication Module 20 shown with motion/impact lines and creating a surface pulse 16. Two-way communication 26 between the Surface Communication Module and the Surface Control System 28 is shown to be accruing wirelessly via the dotted line 82. Below the wellhead, a downhole tool string 80 is suspended via the slickline or braided line cable 12. This cable passes through an upper sheave and a lower sheave and is shown with downhole pulses 14 and surface pulses 16 travelling through it. The Downhole Communication Module 30 is attached to the slickline or wireline cable and is depicted creating a downhole pulse 14 denoted by the motion/impact lines shown in the illustration.

100 Overview of slickline equipment with a 2-way communication system
200 Surface Components
300 Downhole Components
20 Surface Communication Module
30 Downhole Communication Module
40 Upper Sheave
50 Lower Sheave
60 Stuffing Box Assembly
70 Preferred embodiment of a Surface Communication Module
80 Downhole tool string
12 Slickline or braided line cable
14 Downhole pulse (generated from the Downhole Communication Module)
16 Surface pulse (generated from the Surface Communication Module)
18 Sample casing or tubing
22*a* Sample downhole tool 1
22*b* Sample downhole tool 2
22*c* Sample downhole tool 3
24 Data and/or power cable
26 Depiction of two-way communication
28 Surface Control System (computer, control panel, tablet, or similar)
32 Depiction of ground plane
34 Lubricator segments
36 Blow-out preventers
38 Adapter to wellhead
42 Sample wellhead
44 chain/rope/cable
46 Lower sheave assembly
48 Main body of surface communication module
52 Attaching feature to item 44
54 Attaching feature to item 46
56 Upper sheave assembly
58 Stuffing box main body
62 Sheave mounting collar
64 Adapter to lubricator
66 Communication module for sheave assembly
68 Upper sheave wheel
72 Cable attachment feature on downhole communication module
74 Main body of downhole communication module
76 Wireless transmission antenna
78 Detached Surface Pulse Detector Unit
82 Line depicting a wireless connection
84 Pneumatic line
86 Surface Pulse-Generator Unit

DETAILED DESCRIPTION OF THE INVENTION

Reference is now made to the drawings which depict preferred embodiments of the disclosed method and system but are not drawn to scale. The descriptions and figures within this document are intended to exemplify a typical installation or use of Slickline and braided line services, however, the components used on a service may vary depending on the requirements for the service, whether the service is performed onshore or offshore, whether wellhead pressure is expected or not, how much physical space is available on the rig pad or platform etc. These possible variants are not illustrated but the body of work is intended to cover all these possible variants as the invention presented herein is applicable to all conditions on which slickline or braided line services are rendered.

In slickline or braided line services, several pieces of equipment are used to lower one or a plurality of downhole tools into a wellbore. Said tools are used to perform a variety of services such as data collection (in memory), cleaning, and actuation of devices to name a few. The overview illustration shown in FIG. 1, illustrates standard equipment used to perform slickline or braided line services along with devices described herein for enabling two way communication capabilities to such slickline and braided line services. The devices, modules, or components used for enabling such two-way communication capabilities comprise primarily a Downhole Communication Module (DCM) 30, a Surface Communication Module (SCM) 20, and a Surface Control System (SCS) 28, all operably connected to each other and by means of an electrical and mechanical connection, also connected to a downhole tool string 80.

Further expanding on the description of a system for enabling two-way communication through slickline shown in FIG. 1, A user (or operator) can use the SCS 28 to observe and record data generated by the downhole tool string 80 and can also issue instructions or commands to individual downhole tools comprising this tool-string 80. The Surface Control System 28 can be a computer, control panel or tablet, and acts as the principal interface between the two-way communication system described herein and an operator. The data rate and type of data received from the tool string 80 can be requested or altered using this control interface, and likewise, it can also be used to send instructions to the different tools in the downhole tool-string 80. Such instructions can vary depending on the tool that the operator wants to address, but they can include actuation of motors, expansion or contraction of tool elements, opening or closing of valves or sleeves, axial movement such as in downhole tractor or stroking tool, actuation of an explosive change such as in a perforating gun, instruction to begin or terminate operations such as cutting, sampling or taking data, amongst many others possible commands.

Figure 2:
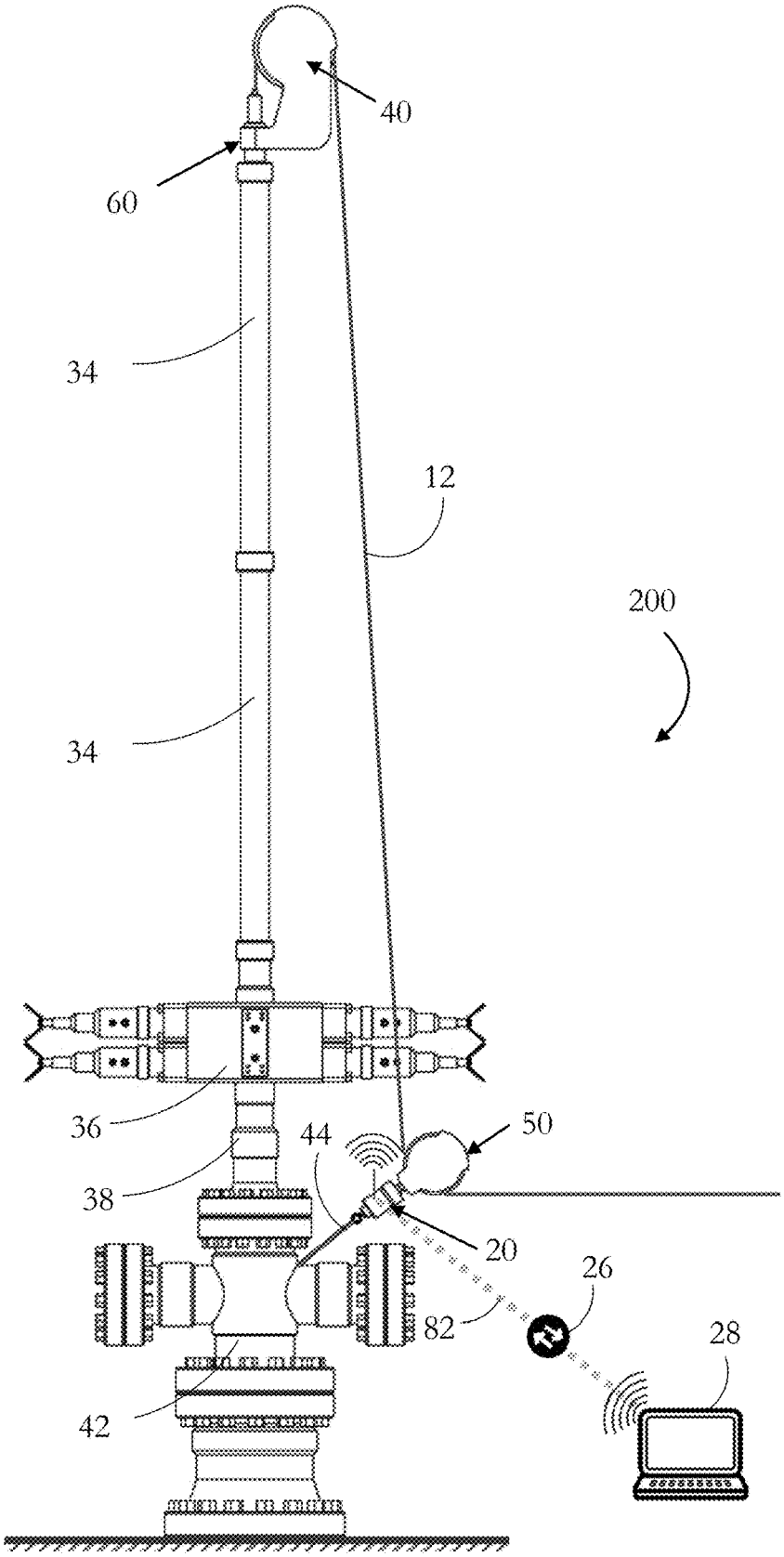
FIG. 2 Shows a closer overall view of the surface components previously shown in FIG. 1. In this figure, the Surface Communication Module 20 is shown at rest therefore not creating a pulse. This module is shown attached to a wellhead 42 via a chain, cable or similar 44. The slickline or braided line 12 is shown in this instance with no pulses going through it. A wellhead 42 is shown connected to a blow-out-preventer (BOP) 36 via an adapter 38. On top of the BOP, two lubricator segments 34 are shown with a stuffing box 60 and upper sheave assembly 40 mounted on top and a lower sheave assembly 50 shown near the wellhead.
Figure 5:
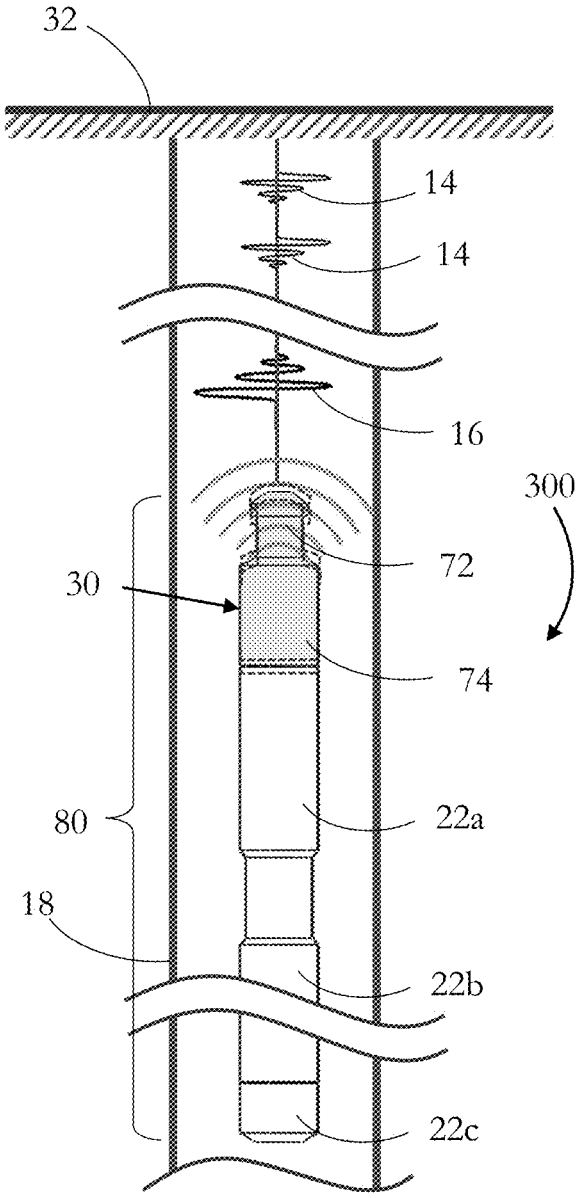
FIG. 5 Shows a closer overall view of the downhole components previously shown in FIG. 1. A downhole tool string 80 is attached to a slickline or braided line cable 12. The Downhole Communication Module 30 is shown attached to the cable 12 via an attachment module or cable head 72. The Downhole Communication Module 30 is shown with motion lines creating downhole pulses 14 through the downhole pulse generator unit. Below the Downhole Communication Module 30, three downhole tools (samples) 22, 22*b*, 22*c* are shown, connected to the downhole component 30 via a connection on the main tool body 74. A surface pulse 16 is shown travelling down the cable.
Figure 6:
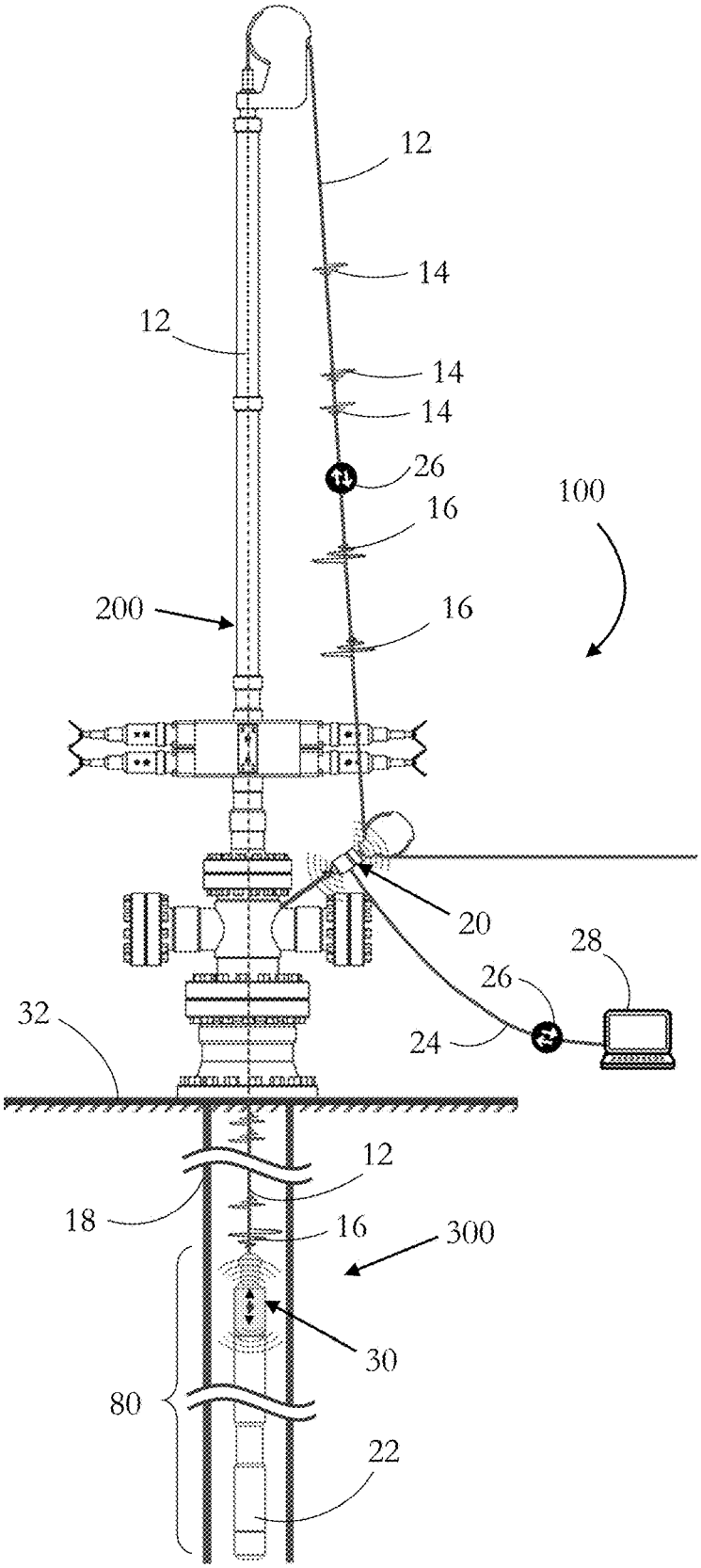
FIG. 6 Depicts an alternative embodiment of the system shown in FIG. 1, on which a cable is used to provide data between the surface communication module 20 and the surface control system 28.
Figure 7:
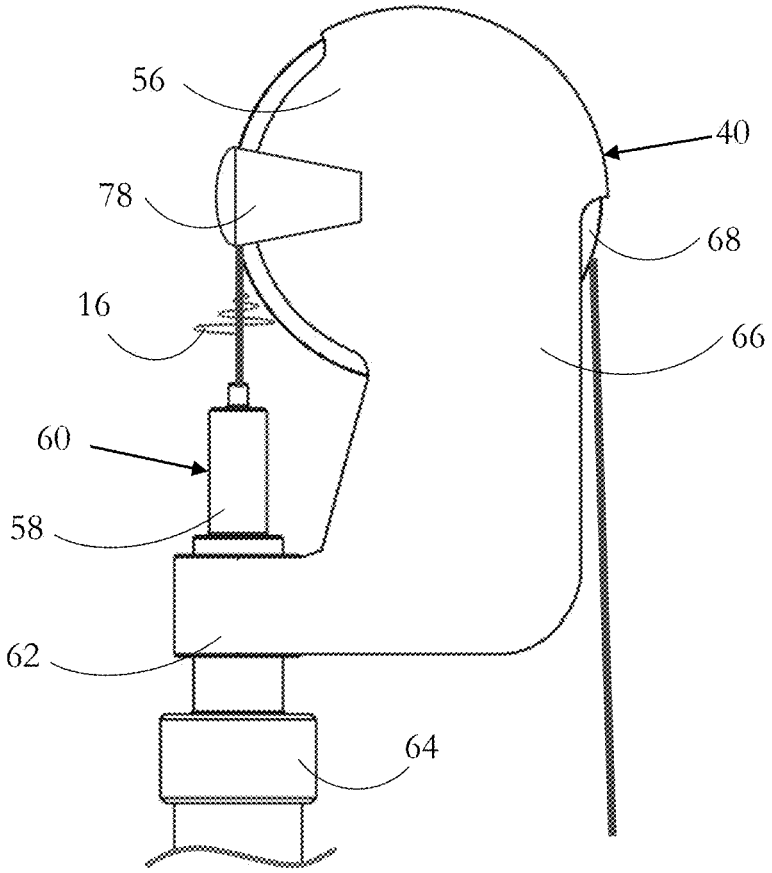
FIG. 7 Shows an embodiment of the system on which a Surface Pulse-Detector Unit 78 is not part of the main Surface Communication Module, meaning it is detached and independent from it. In this illustration, this Surface Pulse-Detector Unit 78 is attached to the upper sheave assembly, but it can be located at a different point of the system.

Specific software and a user interface within the SCS 28 are required for encoding user input into a pattern/series of pulses which are then transmitted to the SCM 20 so that said module can recreate said pattern of pulses using a Surface Pulse Generator Unit (SPGU) which is part of the SCM 20. This sending and receiving of data between the SCS and a SCM 20 is shown by the wireless connection line 82 between both devices and by the two-arrow symbol 26 conveying that communication occurs both ways between these modules. The slickline or braided line cable 12 typically passes through a lower sheave 50, then an upper sheave, 40 and going through a pressure-control assembly shown in better detail on FIG. 2, which is, on this embodiment, comprised of a stuffing box assembly 60, lubricator segments 34, a blowout preventer or BOP 36 and a wellhead 42. The cable 12 further continues going through the downhole section or a wellbore, better shown on FIG. 5, passing below the ground level 32 and into a wellbore which is shown with casing or tubing 18 installed. The cable 12 is then secured to a DCM 30 which is itself connected to the downhole tool-string 80.

Figure 3:
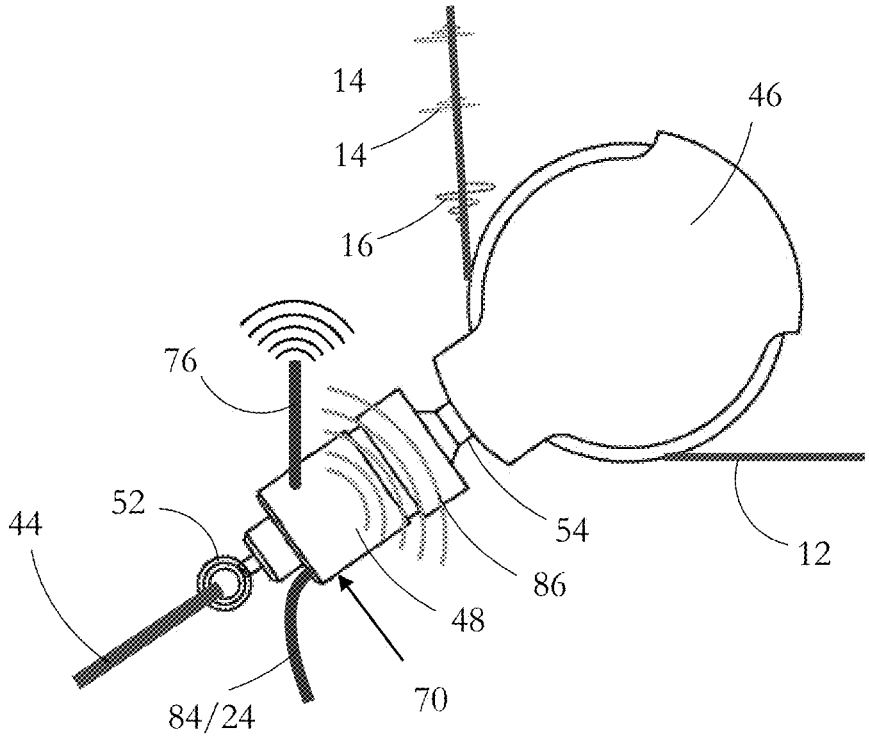
FIG. 3 Depicts a preferred embodiment of the Surface Communication Module 20 in further detail. The module is shown with an eye bolt or similar device 52 attaching it to a wellhead (not shown) through a rope, cable, or chain 44. The Surface Communication Module 20 is shown making a motion/impact (depicted using motion lines) which create surface pulses 16 which travel up the slickline cable 12. A cable 84/24 attached to the body of the Surface Communication Module 20 is depicted. This cable can be a pneumatic line 84 which can drive a surface pulse-generator unit 86, or a power/data cable 24 which can also drive the surface pulse generator 86. An antenna 76 is shown broadcasting data wirelessly to the Surface Control System 28 (not shown here).
Figure 4:
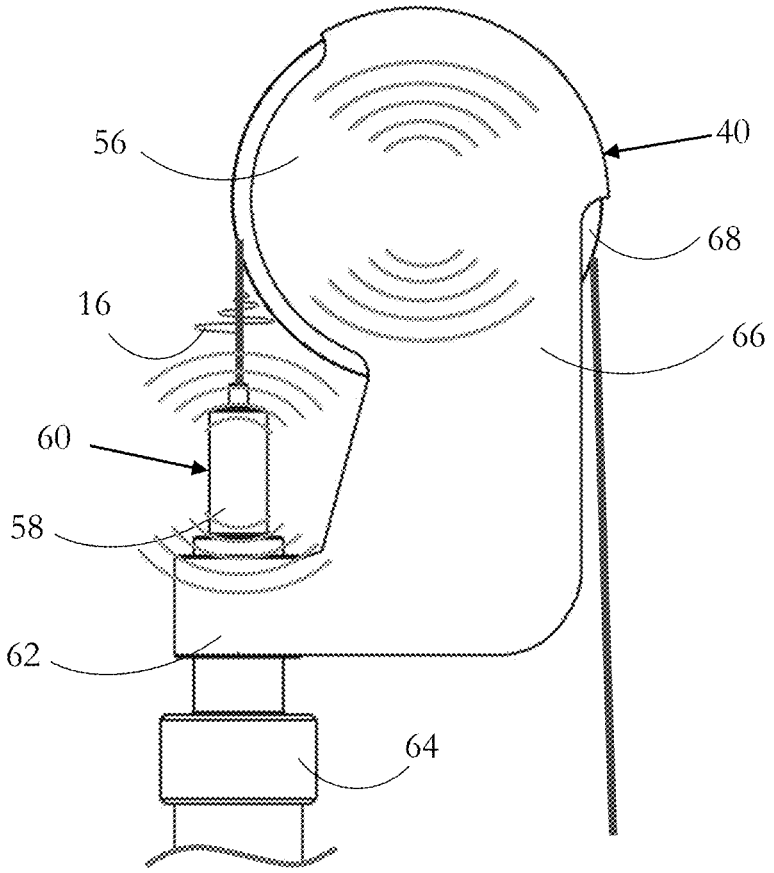
FIG. 4 Shows two alternative embodiments of the Surface Communication Module 20. The surface pulse-generator unit 86 can be integrated onto an upper sheave assembly 40 which consists of a sheave wheel 68, an assembly housing 56 and 66. The surface pulse-generator unit contained within, generates a surfaced pulse 16. Additionally, in another embodiment, the surface pulse-generator unit 86 can be integrated onto or near a stuffing box assembly 60. Power can be delivered via a cable (not shown), a battery, or a pneumatic line for driving the surface pulse generator. Additionally, the main Communication to the Surface Control Interface can be through a cable or wirelessly.

The Surface Communication Module 20 embodiment shown in FIG. 3 is the preferred embodiment of this module and therefore will be used as the default for the remaining of this description section. In this embodiment, the Surface Communication Module (SCM) is secured to a lower sheave. In this embodiment, a SCM comprises a means of securing the module to a lower sheave and to another anchor point which as an example could be a rig floor, a wellhead, or other; the SCM also further comprises a Surface Pulse-Detector Unit (SPDU), a Surface Pulse Generator Unit (SPGU), a Surface Data-Relay Unit (SDRU), and a Surface Power Unit (SPU). Instructions from the Surface Control System 28 are received wirelessly or via a cable by the SDRU within the Surface Communication Module 20 in the form of a specific pattern of pulses. These surface pulses 16 are then re-created by the Surface Pulse-Generator Unit depicted by the movement lines depicted on FIGS. 1, 3, 4, and 6. The Surface Pulse Generator Unit in its preferred embodiment, uses pneumatic power to actuate a mechanical hammer mechanism which in turns creates the surface pulses 16 which travel through the slickline or braided line the cable 12. The intensity, duration and or frequency of these pulses are in a specific pattern which is used to convey information through the cable 12.

These surface pulses 16 travel through the cable 12 reaching a Downhole Communication Module 30 which is firmly secured to the cable 12. The Downhole Communication Module 30, comprises a means to securing the cable or Cable Head, a Downhole Pulse-Detector Unit (DPDU), a Downhole Pulse Generator Unit (DPGU), a Downhole Telemetry Unit (DTU), and a Downhole Power Unit (DPU). The lower end of the DCM is further mechanically and electrically connected to the plurality of downhole tools that can comprise a tool-string. The DPDU is used to detect the surface pulses 16 generated by the surface component 20. This DPDU uses in its preferred embodiment an accelerometer for detecting said pulses. The DTU is then used to decode the pattern of pulses into useful information, which is then relayed to the various tools 22*a*, 22*b*, 22*c* in the tool-string 80 by the mechanical and electrical connection at the bottom of the DCM 30. These instructions can initiate, modify or stop a variety of actions for the downhole tools to perform.

Downhole tools in the tool string 80 may have the capability to produce data or information related to their function. Some examples of this information can be pressure and temperature data, depth data, flow rate data, or other type of sensor-related data as well as information related intrinsically to the tool itself and its operation such as confirming an instruction has been received and the action was performed appropriately. This feedback, when and if transmitted actively or upon request, can be very useful in a wide variety of applications. This information, whether it is data from sensors, or feedback from the downhole tools 22*a*, 22*b*, 22*c*, etc.

The Downhole Telemetry Unit part of the Downhole Communication Module 30 receives said information from the downhole tools 22*a*, 22*b*, 22*c*, etc. and encodes it into a specific pattern of pulses, which are then created by the Downhole Pulse-Generator Unit. The preferred embodiment of the DPGU generates said downhole pulses 14 by using a solenoid to repeatedly actuate a mechanical hammer assembly. This mechanical hammer assembly is firmly secured to the cable attachment assembly 72 and allows for transmission of the downhole pulses 14 through the slickline or wireline cable 12. Additional embodiments of the DPGU include the use of a piezoelectric component, electric-motor driven hammer assembly, or a vibration assembly in place of the solenoid driven assembly to create downhole pulses. The Downhole Power Unit which comprises high-temperature batteries, and/or capacitors provides the DCM entire tool-string 80 with electrical energy.

The downhole pulses 14 generated by the DPGU within the DCM 30 and which are the basis of conveying data from the downhole tool string 80 to the surface, are detected at the surface via the Surface Pulse-Detector Unit which is part of the Surface Communication Module 20. The SPDU comprises in a preferred embodiment, an accelerometer coupled with onboard electronics and an apparatus for making direct or indirect contact with the slickline or braided line cable in order to improve the detection of said downhole pulses 14. In a plurality of embodiments, the SPDU can also be independently detached from a Surface Communication Module assembly. In these embodiments, a SPDU can be mounted in various locations which can be in direct or indirect contact with a slickline or braided line cable. Direct contact in this context is defined as having a component of the SPDU touching the slickline or wireline cable, while, indirect contact is defined as having a component of the SPDU touching a component which is in contact with another component, which itself can be in contact with yet another component which ultimately is in direct contact with a slickline or braided line cable. In these embodiments where a SPDU is independent or detached, the SPDU comprises a mounting assembly, a power source, onboard electronics, a sensor unit, and a transmitter unit. Upon detection, the pattern of downhole pulses 14 is then relayed via the Surface Data-Relay Unit to the Surface Control System 28 where it is then decoded by specialized software into useful data displayed in a manner which an operator can understand depending on the data being displayed it being sensor data, tool status, etc.

The terms and descriptions used herein are set forth by way of illustration only and are not meant as limitations. Those skilled in the art will recognize that many variations are possible within the spirit and scope of the invention as defined in the following claims, and their equivalents, in which all terms are to be understood in their broadest possible sense unless otherwise indicated.

We claim:

1. A system for enabling two-way communication and data transfer between downhole tools and surface equipment utilizing slickline or braided line cable, comprising:

a slickline or braided line cable, a downhole communication module, and a surface communication module operably connected to a surface control system wherein the surface control system is configured to receive data from a downhole tools and the modules, record the data, perform actions based on the data, and issue commands to the modules and/or to the downhole tools;

wherein the downhole communication module fitted with devices includes at least downhole accelerometer for detection of pulses received through the slickline or braided line cable from the surface communication module and at least downhole mechanical hammer for generation of pulses to be sent in the form of impact, or vibrations which travel through the slickline or braided line cable up to the surface communication module, wherein the detected pulses decoded into data by an onboard downhole telemetry unit, and sending the data to the downhole tools connected to the downhole communication module, wherein the surface communication module fitted with a data relay unit, and devices includes at least surface accelerometer for a detection of pulses and surface mechanical hammer for generation of pulses in the form of impact, or vibrations, wherein the data relay unit is used for receiving data and commands from the surface control system and for instructing a pulse generator unit, which is part of the surface communication module, to producing pulses intended to traveling to the downhole communication module via slickline or braided line cable;

the surface control system receiving and displaying the data originated from the downhole tools and allowing a user to inputting commands or loading information, and sending such data, commands, or information to a surface communication module for the subsequent transmission of the data to said downhole communication module.

2. The system according to claim 1, wherein said downhole communication module is secured to the slickline or braided line cable.

3. The system according to claim 2 comprising: a downhole power component, a pulse detector component, a pulse generator component, a downhole telemetry component, and a cable securing component.

4. The system according to claim 3 comprising a strain gauge component for detecting pulses.

5. The system according to claim 3 comprising a microphone or acoustic component for detecting pulses.

6. The system according to claim 3 comprising a solenoid assembly for creating a succession of impacts which then in turn create pulses which propagate through a cable.

7. The system according to claim 3 comprising a piezoelectric assembly for creating a succession of acoustic waves which then in turn create pulses which propagate through a cable.

8. The system according to claim 3 comprising an electric motor for creating a succession of impacts which then in turn create pulses which propagate through a cable.

9. The system according to claim 3 comprising an electric motor and unbalanced rotational assembly for creating a succession of vibrations which propagate through a cable.

10. The system according to claim 1, wherein said surface communication module is in direct or indirect contact with the slickline or braided line cable.

11. The system according to claim 10 comprising: a pulse detector component, a pulse generator component, a data relay component, and a power component.

12. The system according to claim 11 wherein the accelerometers is are a pulse detector component.

13. The system according to claim 11 wherein a strain gauge is a pulse detector component.

14. The system according to claim 11 wherein a microphone or acoustic component is used for detecting pulses.

15. The system according to claim 11 wherein a solenoid assembly is used for creating a succession of impacts which then in turn create pulses which propagate through a cable.

16. The system according to claim 11 wherein a piezoelectric assembly is used for creating a succession of acoustic waves which then in turn create pulses which propagate through the cable.

17. The system according to claim 11 wherein an electric motor and the mechanical hammer assembly are used for creating a succession of impacts which then in turn create pulses which propagate through the cable.

18. The system according to claim 11 wherein an electric motor and unbalanced rotational assembly is used for creating a succession of vibrations which propagate through the cable.

19. The system according to claim 11 wherein a pneumatic motor and mechanical hammer assembly are used for creating a succession of impacts which then in turn create pulses which propagate through the cable.

20. The system according to claim 11 wherein a wireless adapter component is used for sending and receiving data to and from a surface control system.

21. The system according to claim 11 wherein the cable connection to the surface control system is used for sending and receiving data to and from the downhole communication module.

22. The system according to claim 1, wherein said surface communication system is a computer, laptop or desktop, comprising at least a wireless adapter, a cable connection, and software for decoding pulses into data and for encoding data and commands into pulses.

23. The system according to claim 22 wherein the surface control system is a tablet PC comprising a wireless adapter, a cable connection and software for decoding pulses into data and for encoding data and commands into pulses.

24. The system according to claim 23 wherein the surface control system is a control panel comprising a display or screen, onboard memory, an onboard CPU, a wireless adapter, a cable connection, and software for decoding pulses into data and for encoding data and commands into pulses.

25. A method for enabling two-way communication and data transfer between downhole tools and surface equipment utilizing slickline or braided line cable comprising:

attaching a downhole communication module to the slickline or the braided line cable, having said downhole communication module fitted with devices includes downhole accelerometer for detection of pulses received through the slickline or braided line cable from a surface communication module and downhole mechanical hammer for generation of pulses to be sent in the form of impact, or vibrations which travel through the slickline or braided line cable up to the surface communication module, wherein the detected pulses decoded into data by an onboard downhole telemetry unit, and sending the data to a downhole tools connected to the downhole communication module, having a surface communication module fitted with a data relay unit, and devices includes surface accelerometer for a detection of pulses and surface mechanical hammer for generation of pulses in the form of impact, or vibrations, wherein the data relay unit is used for receiving data and commands from a surface control system and for instructing a pulse generator unit, which is part of the surface communication module, to producing pulses intended to traveling to the downhole communication module via slickline or braided line cable, having surface control system receiving and displaying the data originated from the downhole tools and allowing a user to inputting commands or loading information, and sending such data, commands, or information to a surface communication module for the subsequent transmission of the data to said downhole communication module.

26. The method according to claim 25 for sending data from downhole tools through slickline or braided line cable comprising having a downhole communication module fitted with a device for creating pulses through said cables via impact, vibration, or acoustic waves, firmly secured to said cable.

27. The method according to claim 25 for downhole tools receiving data from surface equipment through slickline or braided line cable comprising having a downhole communication module fitted with a device for detecting pulses travelling through said cables via the use of an accelerometer.

28. The method according to claim 25 for receiving data from downhole tools through slickline or braided line cable comprising having the surface communication module fitted with certain devices for detecting pulses travelling through said cables via the use of an accelerometer.

29. The method according to claim 25 for sending data and commands from surface equipment to downhole tools through slickline or braided line comprising having the surface communication module fitted with a device for creating pulses through said cables via impact, vibration, or acoustic waves, being attached to said cable.

* * * * *